US010052780B2

(12) United States Patent
Buchholz

(10) Patent No.: US 10,052,780 B2
(45) Date of Patent: Aug. 21, 2018

(54) HYDRAULIC PUNCH MACHINE, AND PUNCH CARRIER FOR A PUNCH MACHINE

(71) Applicant: TKR Spezialwerkzeuge GmbH, Gevelsberg (DE)

(72) Inventor: Karl Buchholz, Schwerte (DE)

(73) Assignee: TKR Spezialwerkzeuge GmbH, Gevelsberg (DE)

( * ) Notice: Subject to any disclaimer, the term of this patent is extended or adjusted under 35 U.S.C. 154(b) by 0 days.

(21) Appl. No.: 15/282,980

(22) Filed: Sep. 30, 2016

(65) Prior Publication Data

US 2017/0087736 A1 Mar. 30, 2017

(30) Foreign Application Priority Data

Sep. 30, 2015 (DE) ..... 10 2015 116 562

(51) Int. Cl.
*B26D 7/26* (2006.01)
*B21D 45/00* (2006.01)
(Continued)

(52) U.S. Cl.
CPC ..... *B26D 7/2614* (2013.01); *B21D 28/34* (2013.01); *B21D 37/04* (2013.01); *B21D 45/003* (2013.01);
(Continued)

(58) Field of Classification Search
CPC ..... B26D 7/2614; B26D 7/18; B26D 7/26; B26D 2007/189; B21D 45/006;
(Continued)

(56) References Cited

U.S. PATENT DOCUMENTS 3,211,035 A * 10/1965 Whistler, Sr. ..... B21D 45/006 83/139
3,335,627 A * 8/1967 Smelts ..... B21D 28/34 83/140
(Continued)

FOREIGN PATENT DOCUMENTS

DE 515 371 A 3/1928
DE 36 37 487 A1 5/1988
(Continued)

OTHER PUBLICATIONS

Extended European Search Report in counterpart European Application No. 16190450.3 dated Feb. 24, 2017 (12 pages).

*Primary Examiner* — Sean Michalski
(74) *Attorney, Agent, or Firm* — Flaster/Greenberg P.C.

(57) ABSTRACT

The invention relates to a punch carrier for a punch machine comprising a piston unit exchangeably arranged on the punch machine, and a punch holder arranged on the piston unit for exchangeably arranging a punch. Furthermore, the invention relates to a hydraulic punch machine comprising: a hydraulically driven punch carrier and a die adapted to a punch. In order to provide a punch machine as well as a punch carrier for a punch machine that reliably allows an easy exchange of the punch to adapt to changing processing requirements, the punch holder has a punch seat transversal to the direction of the longitudinal axis of the piston unit, and a stripper that can be attached to the punch machine and has a passage for the punch, wherein the stripper is designed such that it fixes the punch in an operating position in the punch seat. Furthermore, it is provided that the punch carrier is designed according to one or more of claims 1 to 5.

10 Claims, 4 Drawing Sheets

Figure 1:
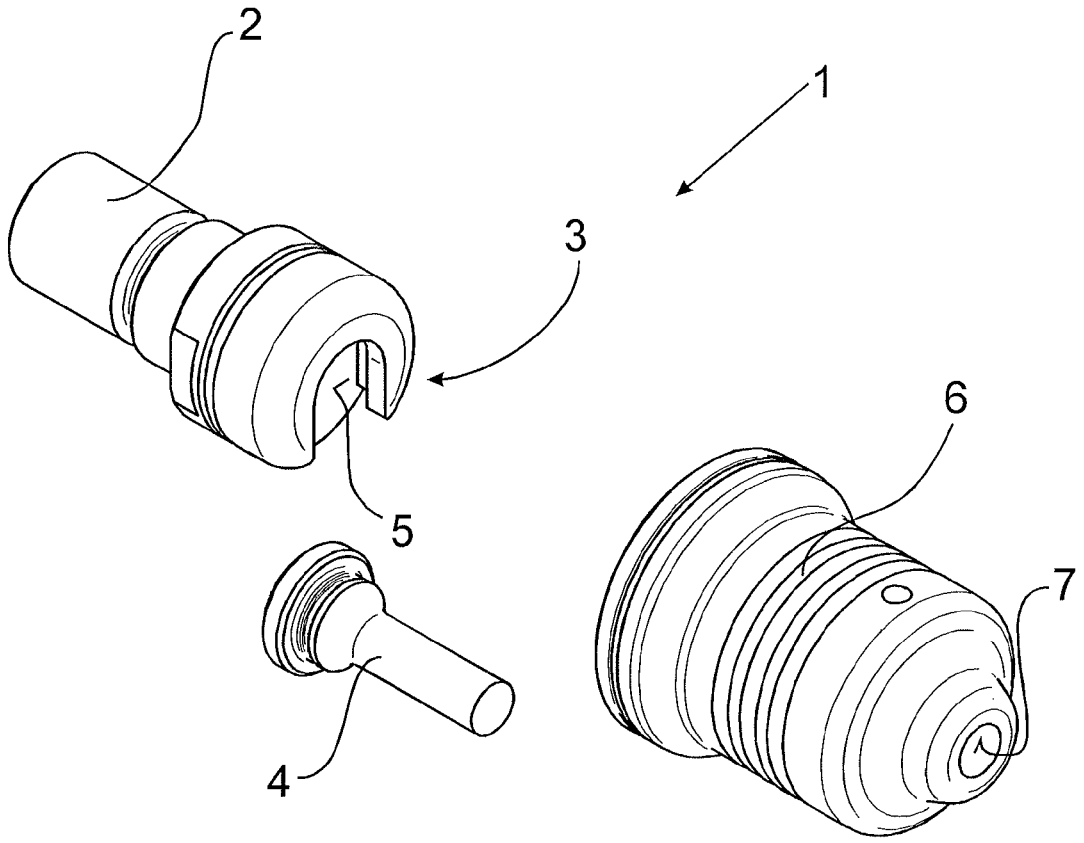

(51) Int. Cl.

| | |
|---|---|
| ***B26D 7/18*** | (2006.01) |
| ***B21D 28/34*** | (2006.01) |
| ***B21D 37/04*** | (2006.01) |
| ***B26F 1/14*** | (2006.01) |

(52) U.S. Cl.
CPC ..... *B21D 45/006* (2013.01); *B26D 7/18* (2013.01); *B26D 7/26* (2013.01); *B26F 1/14* (2013.01); *B26D 2007/1809* (2013.01); *B26D 2007/189* (2013.01)

(58) Field of Classification Search
CPC ..... B21D 28/34; B21D 37/04; B21D 45/003; B26F 1/14
See application file for complete search history.

(56) References Cited

U.S. PATENT DOCUMENTS

RE29,950 E * 4/1979 Bartha ..... B21D 28/24 83/140
4,248,111 A * 2/1981 Wilson ..... B21D 28/34 83/140
4,261,237 A * 4/1981 DiDonato, Jr. ..... B21D 28/34 83/139
5,136,521 A 8/1992 Van Daalen et al.
5,176,057 A * 1/1993 Chun ..... B21D 45/006 83/139
5,301,580 A * 4/1994 Rosene ..... B21D 45/006 83/136
5,438,897 A * 8/1995 Chun ..... B21D 45/006 83/139
5,839,341 A * 11/1998 Johnson ..... B21D 28/34 83/140
6,047,621 A * 4/2000 Dries ..... B21D 28/34 83/136
6,063,228 A * 5/2000 Sasaki ..... B26F 1/14 156/261
6,152,005 A * 11/2000 Ootsuka ..... B21D 45/006 83/138
6,311,594 B1 * 11/2001 Ootsuka ..... B21D 45/006 83/138
6,341,548 B1 * 1/2002 Hirahata ..... B26F 1/3813 83/699.41
7,159,426 B1 1/2007 Ghiran
7,225,659 B2 6/2007 Tomita
7,698,979 B2 * 4/2010 Sugizaki ..... B21D 28/26 83/140
8,327,745 B2 * 12/2012 Lee ..... B21D 28/34 83/686
9,089,986 B2 * 7/2015 Kehoe ..... B26D 7/26
9,669,450 B2 * 6/2017 Nakai ..... B21D 28/34

FOREIGN PATENT DOCUMENTS

| | | | |
|---|---|---|---|
| DE | 690 02 143 | T2 | 3/1994 |
| DE | 10 2006 045 644 | A1 | 4/2007 |
| EP | 1 529 576 | A1 | 5/2005 |
| JP | H09 38730 | A | 2/1997 |
| JP | 2002 143943 | A | 5/2002 |

* cited by examiner

HYDRAULIC PUNCH MACHINE, AND PUNCH CARRIER FOR A PUNCH MACHINE

BACKGROUND OF THE INVENTION

Field of the Invention

The invention relates to a hydraulic punch machine, as well as a punch carrier for a punch machine, comprising:

- a piston unit exchangeably arranged on the punch machine, and
- a punch holder arranged on the piston unit for exchangeably arranging a punch.

Description of Related Art

Punch machines of the initially cited type are used to introduce holes into one or more pieces of sheet metal in a punching process which then serve to accommodate suitable connecting elements such as blind rivets, blind rivet screws and/or blind rivet nuts.

To produce the holes, the pieces of sheet metal are arranged in the punch machine between the punch as well as a die so that the hole can then be punched into the pieces of sheet metal, wherein the punch is adjusted in the direction of the die for this purpose. The size of the holes to be produced is determined according to the diameter of the punching section of the punches. In order to produce different holes, the punches are releasably arranged on a punch holder of a piston unit of the punch machine, wherein the piston unit can be moved in the direction of its longitudinal axis by a drive unit of the punch machine and thereby drives the punch through the pieces of sheet metal to be processed. At present, exchanging the punch is extremely time-consuming, especially since it must be ensured that all of the force acting on the punch in the punching process can be reliably transferred. A precise alignment of the punch is therefore particularly important in order to achieve correct punching results.

BRIEF SUMMARY OF THE INVENTION

The object of the invention is to provide a punch machine as well as a punch carrier for a punch machine that reliably allow the punch to be easily exchanged in order to adapt to changing processing requirements.

The invention achieves this object with a punch carrier having the features of claim 1 as well as a punch machine having the features of claim 6. Advantageous further embodiments of the punch carrier are specified in the dependent claims.

It is characteristic of the punch carrier according to the invention that the punch holder which is arranged on the piston unit and serves to position the punch on the piston unit has a punch seat transversal to the direction of the longitudinal axis of the piston unit, and hence transversal to the direction of movement of the punch during the punching process, into which the punch can be inserted. A stripper of the punch holder provided with a passage for a punch serves to fix the punch arranged in the punch seat in an operating position, wherein for this purpose the stripper can be attached to the punch machine.

The punch seat makes it possible to easily and quickly exchange the punch, wherein when the stripper is in a dismounted state, the punch can be easily removed from and reinserted in the punch seat running transversally to the direction of the longitudinal axis of the piston. Only the stripper which can be attached to the punch machine and which also permits a movement of the piston unit relative to the stripper ensures that the punch is correctly seated in the punch seat in an operating position in which the punching processes can be performed with the punch machine. The stripper prevents the punch from slipping or sliding out of the punch seat.

The punch seat which runs transversally to the direction of the longitudinal axis ensures, on the one hand, that the punch can be easily mounted and dismounted. At the same time, the alignment of the punch seat ensures that the force arising during the punching process in the direction of the longitudinal axis of the piston unit is reliably transferred from the piston unit abutting the punch to the punch so that the punching processes can be performed in the desired manner.

The alignment and shape of the punch seat is freely selectable in principle. The punch seat can hence, for example, run transversally to the direction of the longitudinal axis of the piston unit in an arc. However, according to one particularly advantageous embodiment of the invention, the punch seat is formed by an elongated slot with a C-shaped cross-section which is closed at one end and open at the other end. According to this embodiment of the invention, the elongated slot with a C-shaped cross-section extends from an opening preferably arranged at the edge of the piston unit up to its closed-end. The elongated slot is preferably designed such that the punch is arranged in a preferably central operating position on the piston unit when it contacts the closed end.

The contour of the elongated slot with a C-shaped cross-section makes it possible to easily secure the punch to the piston unit in the direction of the longitudinal axis of the piston unit. During the punching process, the bottom side of the punch then abuts the piston unit. In the opposite direction, the C-shaped sections of the elongated slot secure the position of the punch in the punch seat, wherein the punch has a correspondingly designed main body from which the punch extends through the region between the C-shaped sections of the elongated slot. The elongated slot makes it possible to easily insert the main body of the punch from the open end to the closed end. Furthermore, the punch machine can be quickly adapted, wherein different punches with identical main bodies are used with diameters adapted to the width of the elongated slot, but which have punch sections with different diameters.

The stripper that can be attached to the punch machine serves to secure the position of the punch in the operating position in the punch seat transversal to the processing direction, and the stripper also permits a displacement of the piston unit in the direction of the longitudinal axis, and hence a displacement of the punch relative to the stripper. To make it easier to mount the stripper, the punch seat can, for example, be provided with a lock body that causes the punch to be initially locked in the operating position and then makes it possible to easily mount the stripper.

According to a particularly advantageous embodiment of the invention, the punch seat has a magnetic retaining element in the region of its closed end. The arrangement of the magnetic retaining element is a particularly easy embodiment to initially lock the punch in the operating position in which the punch abuts the closed end of the elongated slot. The magnetic retaining element enables easy mounting as well as dismounting and permits a particularly economical production of the punch carrier. The number and arrangement of the retaining elements can be freely selected according to the existing requirements.

As described above, the stripper serves to secure the exchangeable punch transversal to the longitudinal axis of the piston unit in the operating position on the punch machine. In principle, the stripper can be arranged on the punch machine in any manner. Accordingly, it can, for example, only be shoved in a clamping manner on to a seat on the punch machine, after which the stripper is substantially stress-free during the punching process and, therefore, does not need to be specially secured in position. According to one particularly advantageous embodiment of the invention, the stripper is designed to be lockably arranged in the operating position on the punch machine. This embodiment of the invention ensures that the position of the stripper, and hence the exchangeably arrangeable punch as well, is secured in a particularly reliable manner. The punching process can, therefore, be carried out with particularly high quality and many repetitions since the secured position of the punch is guaranteed with a particularly high level of reliability.

Furthermore, according to another advantageous embodiment of the invention, the stripper has a coating in the contact region with the punch. The coating, preferably a slip-reducing coating, reduces the friction between the stripper and the punch. This minimizes the wear, as well as annoying noise which may arise from friction is effectively prevented.

It is characteristic of the hydraulic punch machine with a hydraulically driven punch carrier and a die adapted to a punch that the punch carrier is designed according to one or more of claims 1 to 5. The punch machine according to the invention is distinguished in that the punch can be exchanged particularly easily and quickly without having to carry out major retrofitting tasks on the punch machine.

BRIEF DESCRIPTION OF THE SEVERAL VIEWS OF THE DRAWING(S)

Figure 2A:
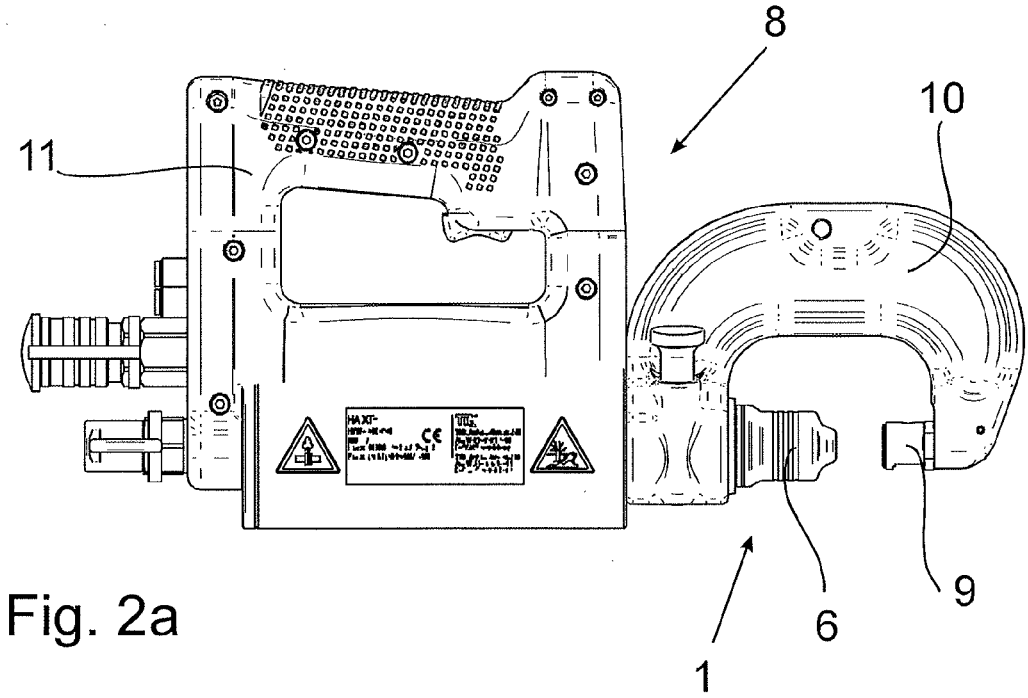

An exemplary embodiment of the invention is explained below with reference to the drawings. In the drawings:

FIG. 1 shows a perspective view of a punch carrier in an exploded view;

FIG. 2*a* shows a side view of a punch machine with a mounted punch carrier.

Figure 2B:
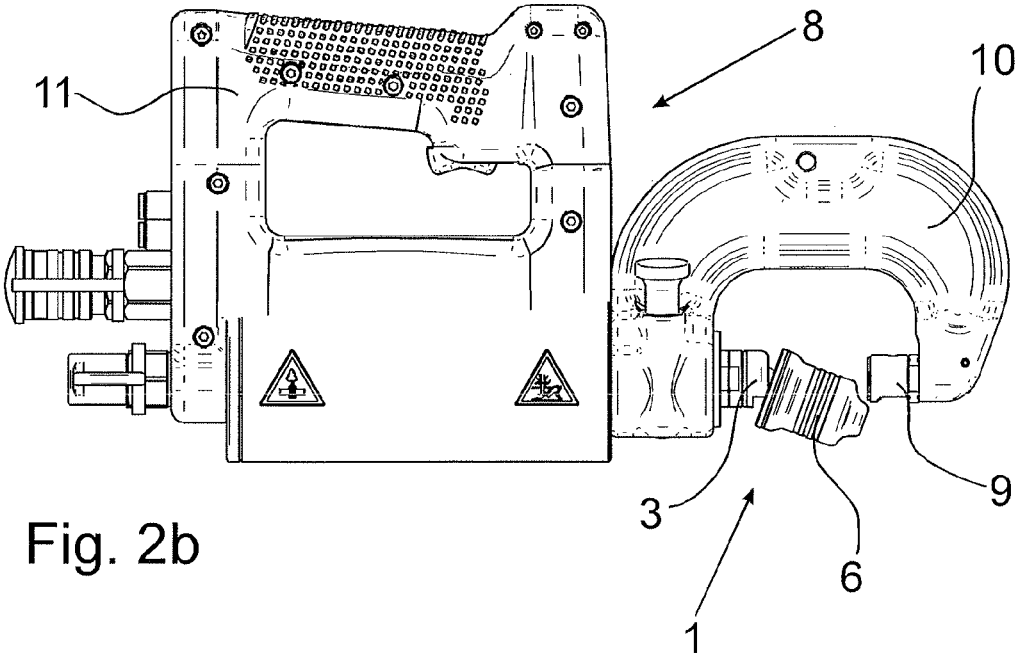
Figure 2C:
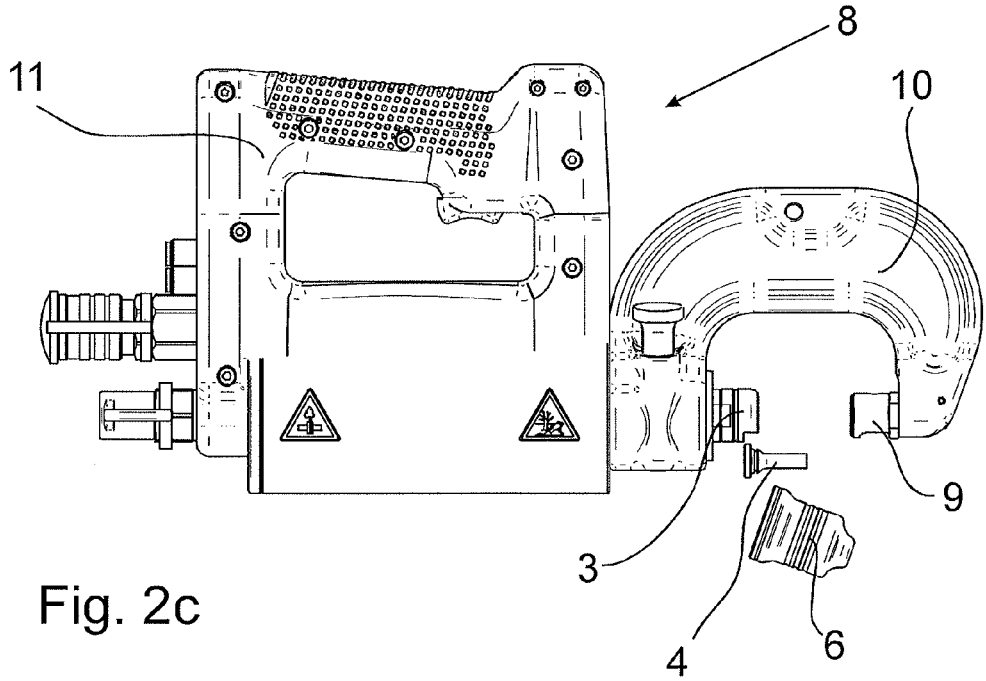
Figure 3A:
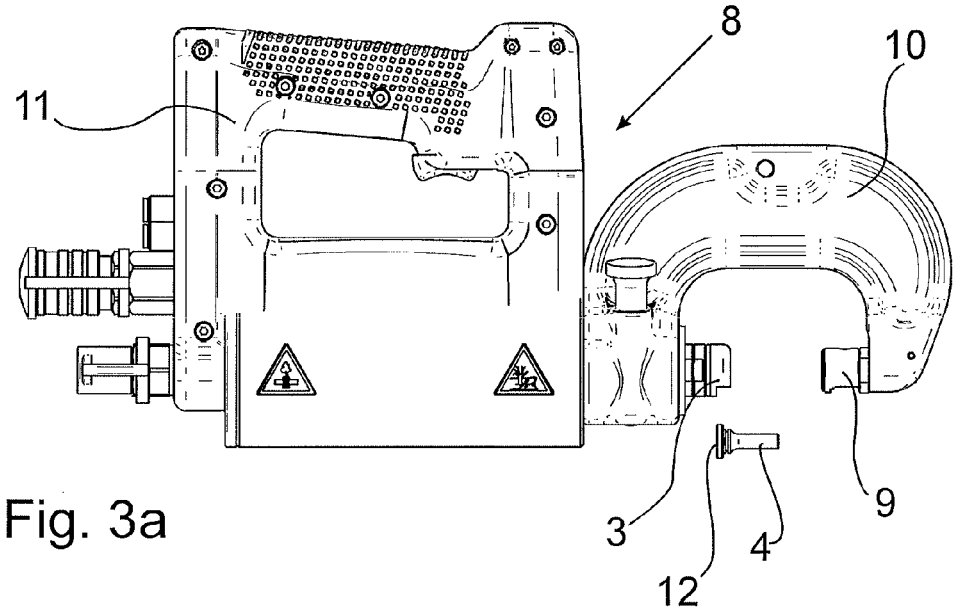
Figure 3B:
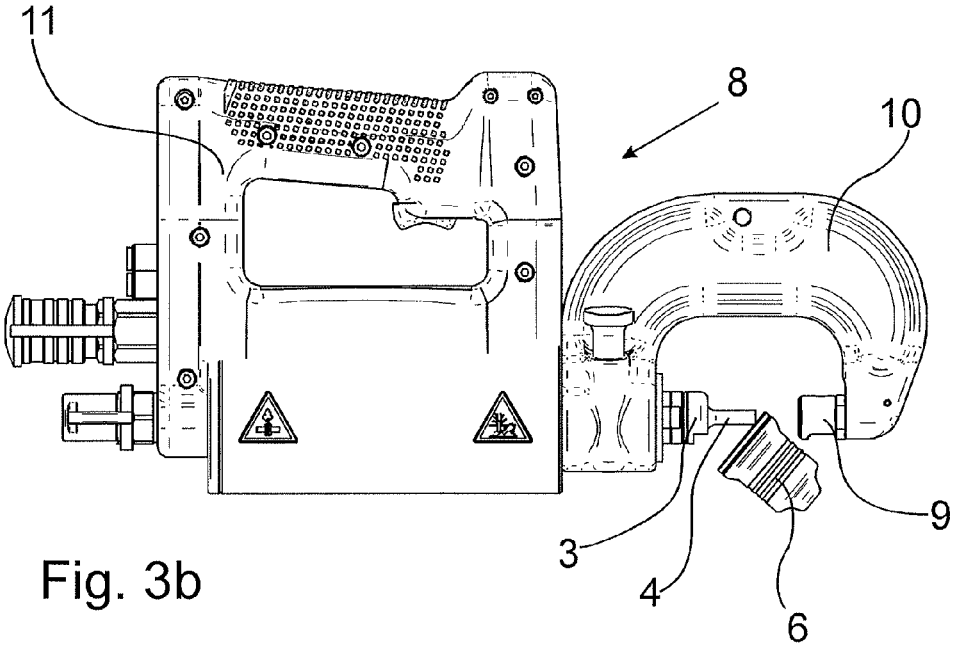
Figure 3C:
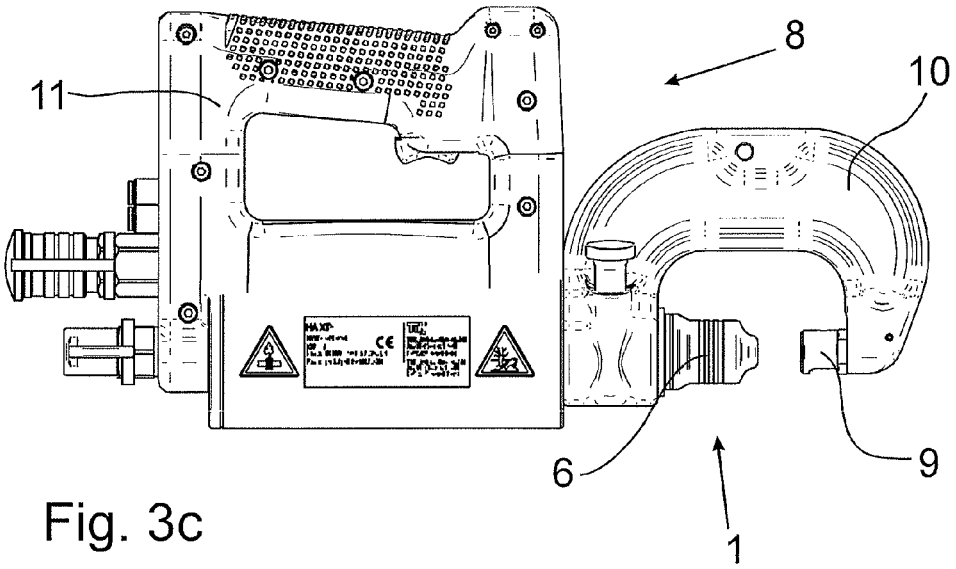

FIG. 2*b* shows a side view of the punch machine from FIG. 1 with a dismounted stripper;

FIG. 2*c* shows a side view of the punch carrier from FIG. 1 with a dismounted punch;

FIG. 3*a* shows a side view of the punch machine from FIG. 1 with a punch to be mounted;

FIG. 3*b* shows a side view of the punch machine from FIG. 1 with a mounted punch and stripper to be mounted; and FIG. 3*c* shows a side view of the punch machine from FIG. 1 with a mounted punch carrier.

DETAILED DESCRIPTION OF THE INVENTION

FIG. 1 shows a perspective view of an embodiment of a punch carrier 1 with a piston unit 2 and a stripper 6. The piston unit 2 is generally exchangeably arranged on a punch machine 8 shown in FIGS. 2*a* to 2*c* and 3*a* to 3*c* so as to be movable in the direction of its longitudinal axis. To accommodate an exchangeable punch 4 on the punch carrier 1, the piston unit 2 has a punch holder 3 with a punch seat 5 which is formed by an elongated slot running transversally to the direction of the longitudinal axis of the piston unit 2 and having a C-shaped cross-section.

A disk-shaped main body 12 of the punch 4 can be inserted up to the closed end of the elongated slot through an open end of the elongated slot in the region of the peripheral surface of the piston unit 2. The diameter and thickness of the main body 12 is adapted to the width and height of the elongated slot so that the C-shaped sections ensure a locking of the punch 4 in the direction of the longitudinal axis of the piston unit 2.

Proceeding from the main body 12, the punch 4 extends with a section that is tapered in comparison with the main body 12, between the C-shaped sections toward the stripper 6 which can be locked on the punch machine 8. The stripper 6 serves to secure the position of the punch 4 in the operating position in which the punch 4 abuts the closed end of the elongated slot by means of the main body 12. A passage 7 in the stripper 6 ensures a passage of the punch 4 when the piston unit 2 is displaced by the punch machine 8 so that corresponding punching processes can be performed by the punch 4.

FIGS. 2*a* to 2*c* depict the easy dismounting of a punch 4 from the clamp 10 of the punch machine 8. Starting from the position of the mounted punch carrier 1 depicted in FIG. 2*a* with the punch 4 installed thereupon, the stripper 6 is removed from the punch machine 8 for dismounting so that the piston unit 2 is accessible that can be adjusted by the drive unit 11 of the punch machine 8 in the direction of the longitudinal axis of the piston unit 2 toward the die 9. After removing the stripper 6, the punch 4 can be removed as shown in FIG. 2*c*.

After removing the punch 4, another punch 4 can be inserted in the punch seat 5 of the punch holder 3 as shown in FIGS. 3*a* to 3*c*, and then fixed in the operating position by mounting the stripper 6. A punch process can be carried out again in the operating position shown in FIG. 3*c*, wherein pieces of sheet metal (not shown) are to be arranged between the stripper 6 and the die 9. By actuating the drive unit 11 of the punch machine 8, the punch 4 is moved through the passage 7 in the stripper 6 toward the die 9, wherein pieces of sheet metal (not shown) located there between are punched corresponding to the diameter of the punch 4.

REFERENCE NUMBER LIST

1 Punch carrier
2 Piston unit
3 Punch holder
4 Punch
5 Punch seat
6 Stripper
7 Passage
8 Punch machine
9 Die
10 Clamp
11 Drive unit
12 Main body

I claim:

1. A punch carrier for a punch machine comprising:

a piston unit exchangeably arranged on the punch machine, and a punch holder arranged on the piston unit for exchangeably arranging a punch, wherein the punch holder has a punch seat transversal to the direction of the longitudinal axis of the piston unit, and a stripper that can be attached to the punch machine and has a passage for the punch, wherein the stripper is designed such that it fixes the punch in an operating position in the punch seat.

2. The punch carrier according to claim 1, wherein the punch seat is formed by an elongated slot with a C-shaped cross-section that is closed at one end and open at the other end.

3. The punch carrier according to claim 1, wherein the punch seat has a magnetic retaining element in a region of a closed end of the punch seat.

4. The punch carrier according to claim 1, wherein the stripper is designed such that it can be locked in the operating position on the punch machine.

5. The punch carrier according to claim 1, wherein the stripper has an anti-friction coating in a contact region with the punch.

6. A hydraulic punch machine comprising:

a hydraulically driven punch carrier and a die adapted to a punch, wherein the punch carrier is designed according to claim 1.

7. A punch carrier for a punch machine comprising:

a piston unit exchangeably arranged on the punch machine, and a punch holder arranged on the piston unit for exchangeably arranging a punch, the punch holder having a punch seat transversal to the direction of the longitudinal axis of the piston unit, the punch seat is formed by an elongated slot with a C-shaped cross-section that is closed at one end and open at the other and the punch seat has a magnetic retaining element in a region of the closed end of the punch seat, and a stripper for attachment to the punch machine, wherein the stripper has a passage for the punch, and the stripper is designed such that it fixes the punch in an operating position in the punch seat.

8. The punch carrier according to claim 7, wherein the stripper is designed such that it can be locked in the operating position on the punch machine.

9. The punch carrier according to claim 7, wherein the stripper has an anti-friction coating in a contact region with the punch.

10. A hydraulic punch machine comprising:

a hydraulically driven punch carrier and a die adapted to a punch, wherein the punch carrier is designed according to claim 7.

* * * * *